US008627587B2

(12) United States Patent
O'Dell

(10) Patent No.: US 8,627,587 B2
(45) Date of Patent: Jan. 14, 2014

(54) DOUBLE WIDE POLE BRACKET AND BANNER SYSTEM

(71) Applicant: David Trevor O'Dell, Evansville, IN (US)

(72) Inventor: David Trevor O'Dell, Evansville, IN (US)

( * ) Notice: Subject to any disclaimer, the term of this patent is extended or adjusted under 35 U.S.C. 154(b) by 0 days.

(21) Appl. No.: 13/851,924

(22) Filed: Mar. 27, 2013

(65) Prior Publication Data

US 2013/0255121 A1 Oct. 3, 2013

Related U.S. Application Data

(60) Provisional application No. 61/616,841, filed on Mar. 28, 2012.

(51) Int. Cl.
*G09F 15/02* (2006.01)

(52) U.S. Cl.
USPC ..... 40/607.12; 40/604

(58) Field of Classification Search
USPC ..... 40/604, 607.01, 607.12
See application file for complete search history.

(56) References Cited

U.S. PATENT DOCUMENTS 2,882,630 A * 4/1959 Frey ..... 40/604
2,893,147 A * 7/1959 Mollet, III ..... 40/604
2,899,764 A * 8/1959 Oberlin ..... 40/604
2,954,627 A * 10/1960 Kies ..... 40/604
2,960,784 A * 11/1960 Frey et al. ..... 40/604
3,089,268 A * 5/1963 Frey et al. ..... 40/604
3,217,437 A * 11/1965 Cobb ..... 40/604
3,310,899 A * 3/1967 Hart et al. ..... 40/604
3,593,450 A * 7/1971 Mollet et al. ..... 40/604
3,609,894 A * 10/1971 Miller ..... 40/655
3,675,356 A * 7/1972 Gilmoure ..... 40/604
3,726,035 A * 4/1973 Bower et al. ..... 40/604
3,842,524 A * 10/1974 Drueck, Jr. ..... 40/606.15
4,890,403 A * 1/1990 Dinan ..... 40/604
5,428,913 A * 7/1995 Hillstrom ..... 40/604
7,810,265 B2 * 10/2010 Beatty ..... 40/607.14

* cited by examiner

*Primary Examiner* — Gary Hoge
(74) *Attorney, Agent, or Firm* — Canyon Law Group

(57) ABSTRACT

A double wide pole bracket and banner system is used to apply banners to poles. The double wide pole bracket system uses slotted, typically steel channel brackets that are affixed to the pole using long, slotted hose clamps with Neoprene pads to protect the pole and prevent slipping. The banner itself can be designed to attach to the brackets with zip ties with a reinforced cutout in the center of the top and bottom hem that permits mounting without infringing on the view of the banner's content. The double wide pole bracket and banner system permits a significantly wider, stronger and more taut pole bracket and banner solution as compared to conventional solutions. The banners can be, for example, as wide as five feet of continuous banner, making the message visible and understandable.

10 Claims, 5 Drawing Sheets

DOUBLE WIDE POLE BRACKET AND BANNER SYSTEM

CROSS-REFERENCE TO RELATED APPLICATION

This application claims the benefit of priority of U.S. provisional application No. 61/616,841, filed Mar. 28, 2012, the contents of which are herein incorporated by reference.

BACKGROUND OF THE INVENTION

The present invention relates to banner brackets and, more particularly, to a double wide pole bracket and banner system for the application of banners to poles.

Almost all available pole banners and bracket systems have several problems. For example, the banner needs to be designed as tall and narrow banners, and hung on the sides of a pole, rendering the graphic and/or message hard to decipher or understand. The bracket is typically made of fiberglass, inserted into a receptor, and strapped to a pole, which can break or blow off in strong wings. Additionally, the bracket hardware is readily visible, unattractive and can easily damage the supporting pole. Furthermore, because the banners have pole pockets on the top and bottom, they often hang loosely, making the banners additionally prone to ripping and even coming off.

As can be seen, there is a need for an improved system for mounting banners onto a pole that can allow "double wide" banners to be applied in a secure and convenient manner, without visible hardware and without damaging the pole on which the banner is mounted.

SUMMARY OF THE INVENTION

In one aspect of the present invention, a pole bracket and banner system comprises a first set of two channel brackets disposed at a first height on a pole; a second set of two channel brackets disposed at a second height on the pole; a plurality of channel slots in the first and second sets of two channel brackets; a first adjustable strap disposed about the pole at the first height, the first adjustable strap extending into one of the plurality of channel slots on each of the first set of two channel brackets and exiting from an adjacent one of the plurality of channel slots on each of the first set of two channel brackets, where tightening the adjustable to the pole secures the first set of two channel brackets at the first height; a second adjustable strap disposed about the pole at the second height, the second adjustable strap extending into one of the plurality of channel slots on each of the second set of two channel brackets and exiting from an adjacent one of the plurality of channel slots on each of the second set of two channel brackets, where tightening the adjustable to the pole secures the second set of two channel brackets at the second height; a first set of two adjustable straps extending about and interconnecting the first set of two channel brackets on each side of the pole; and a second set of two adjustable straps extending about and interconnecting the second set of two channel brackets on each side of the pole.

In another aspect of the present invention, a banner display system is includes a vinyl or mesh banner created with welded hem at the top and the bottom and an appropriate number of grommets that allow the affixing of the banner to the channels above. Furthermore, there is a reinforced cutout in the middle of the top and bottom of the banner that permits affixing and tightening the banner with black zip ties without distortion.

These and other features, aspects and advantages of the present invention will become better understood with reference to the following drawings, description and claims.

DETAILED DESCRIPTION OF THE INVENTION

Figure 1:
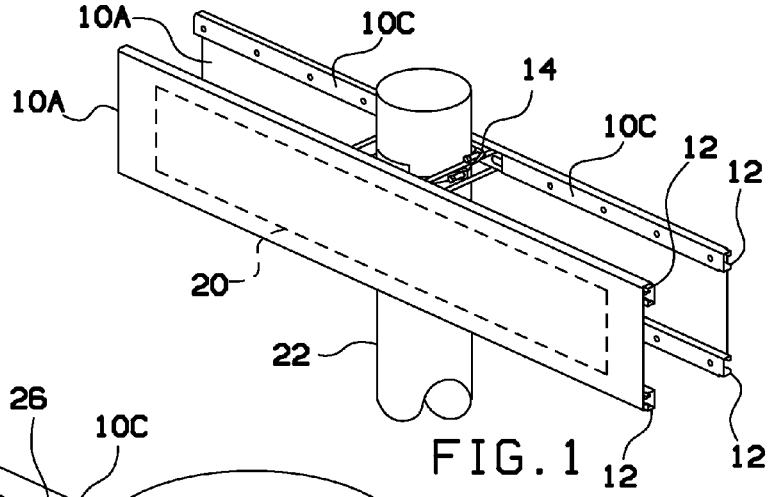
FIG. 1 is a perspective view of a double wide pole bracket, in use to apply a banner to a round pole, according to an exemplary embodiment of the present invention.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a double wide pole bracket and banner system for applying banners to poles. The double wide pole bracket system uses slotted, typically steel channel brackets that are affixed to the pole using long, slotted hose clamps with Neoprene pads to protect the pole and prevent slipping. The banner itself can be designed to attach to the brackets with zip ties with a reinforced cutout in the center of the top and bottom hem that permits mounting without infringing on the view of the banner's content. The double wide pole bracket and banner system permits a significantly wider, stronger and more taut pole bracket and banner solution as compared to conventional solutions. The banners can be, for example, as wide as five feet of continuous banner, making the message visible and understandable.

Referring now to FIGS. 1 through 5, a banner 10 can be supported on a pole 22 with channel brackets 12 that attach to the pole with adjustable clamps 14. The banner 10 can span between two channel brackets 12 on each side of the pole 22, allowing the banner 10 to be made in various lengths (the span between the channel brackets 12) and various widths (the length of the channel brackets 12). Unlike conventional side mounted banners, which are limited in width due to the side mount design, the banners of the present invention can be significantly wider, typically as wide as about five feet, allowing the message on the banner display space 20 to be more visible and understandable.

Figure 2:
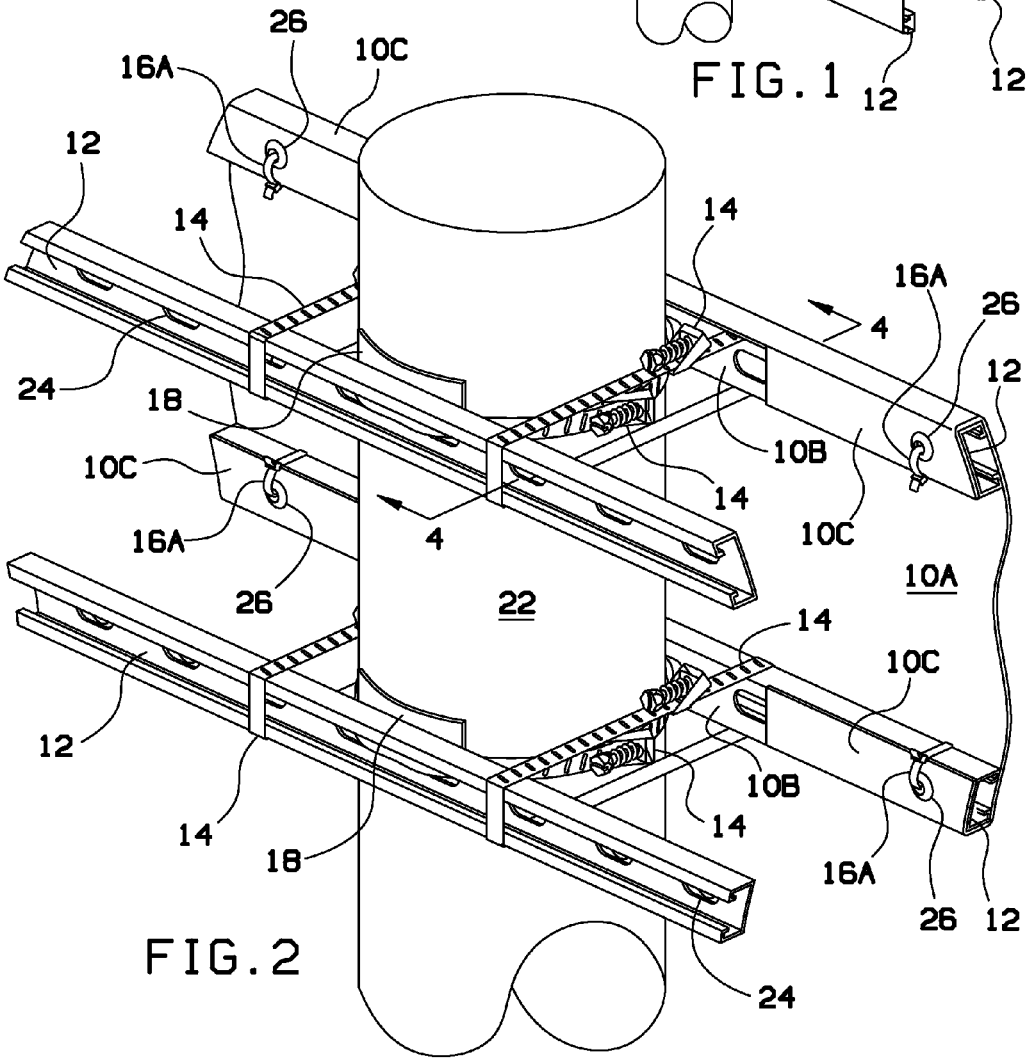
FIG. 2 is a detailed perspective view of the double wide pole bracket of FIG. 1, with the banner removed for clarity.
Figure 3:
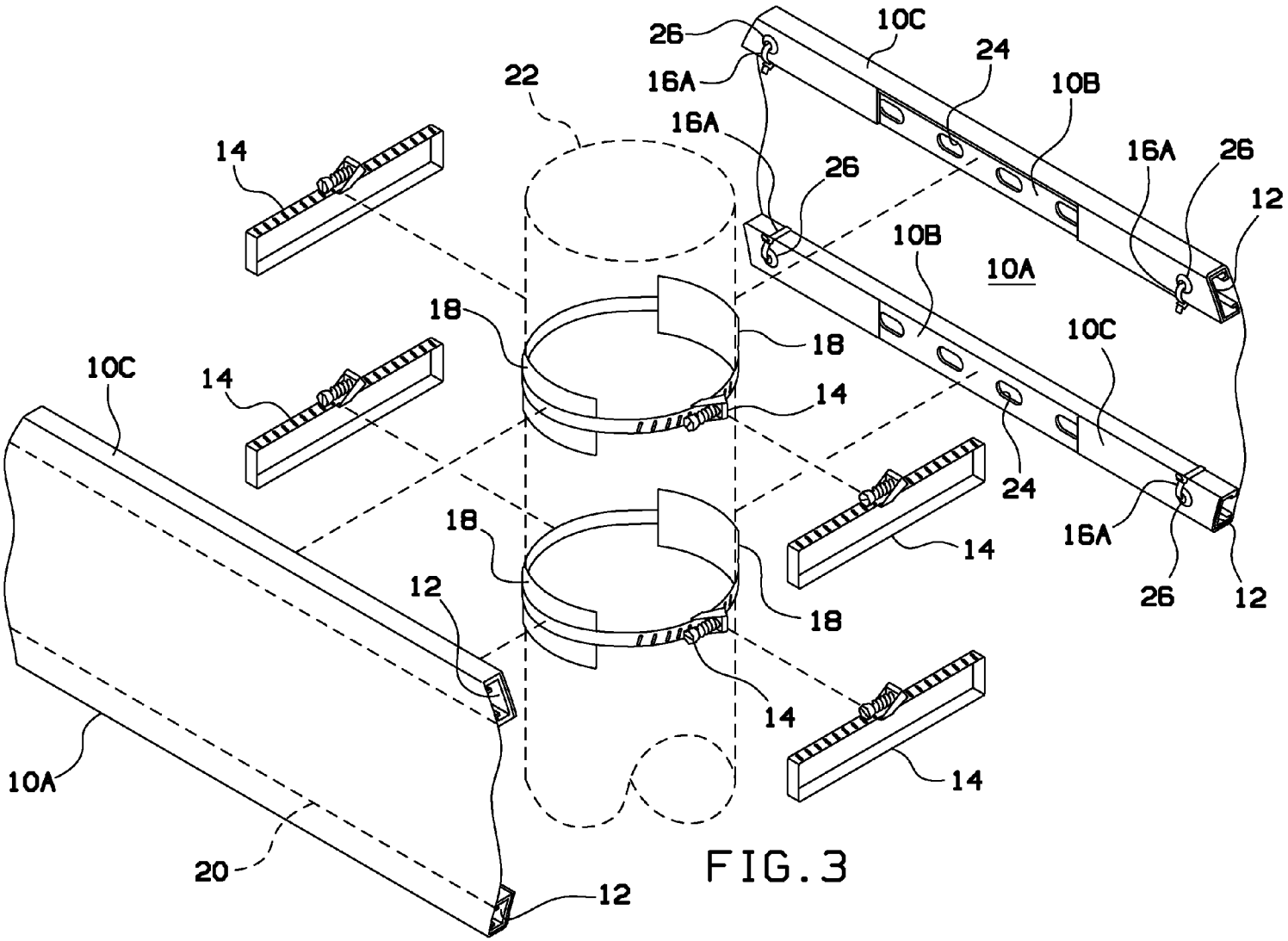
FIG. 3 is an exploded perspective view of the double wide pole bracket of FIG. 1.
Figure 4:
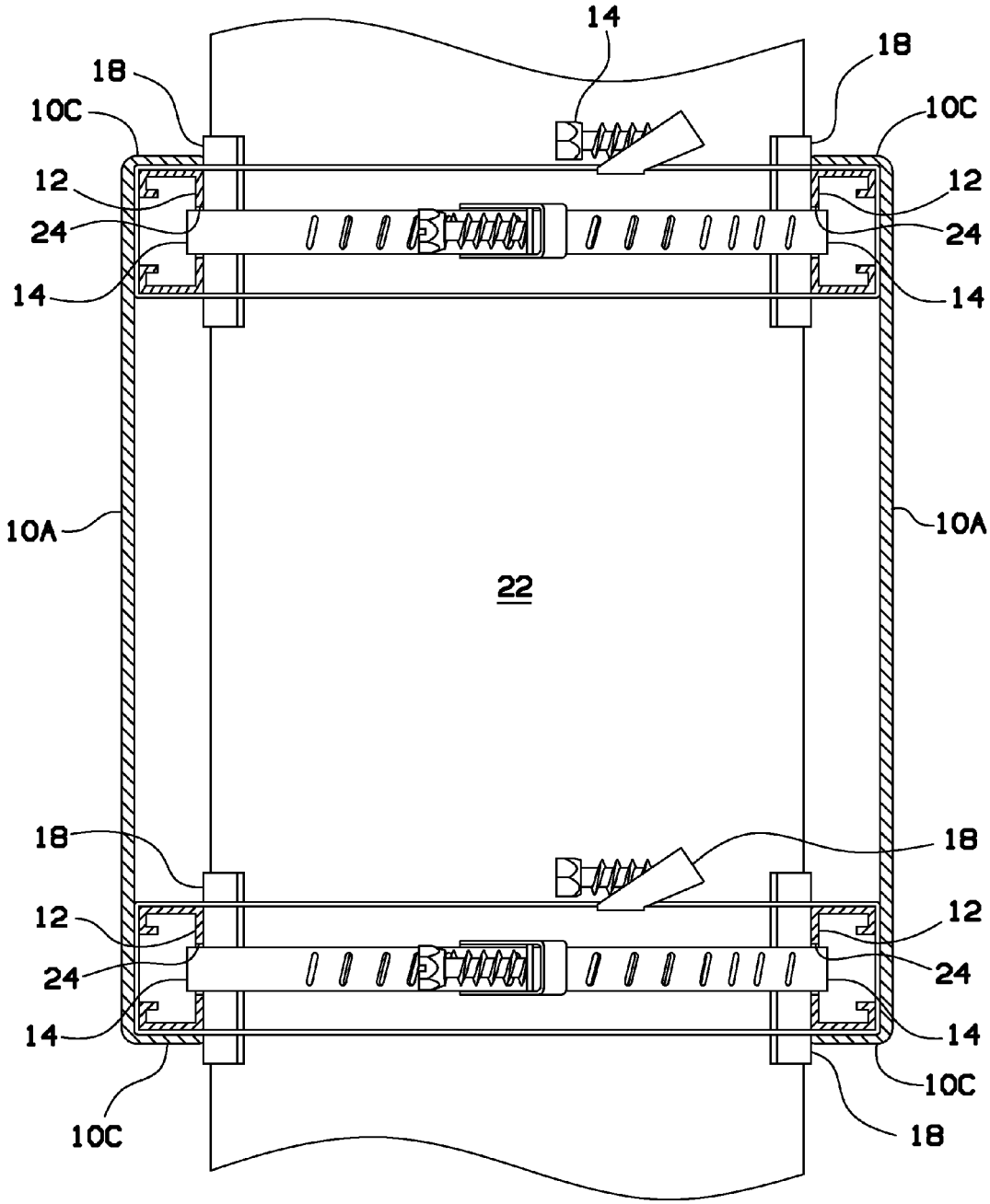
FIG. 4 is a cross-sectional view taken along line 4-4 of FIG. 2.

Anti-slip, protective pads, such as Neoprene pads 18 can be attached to the pole 22 at the appropriate height for placement of the channel brackets 12. In some embodiments, the pads 18 can be disposed only on a portion of the pole 22 where the channel brackets 12 are to be placed, as shown in the Figures. However, in some embodiments, the pads 18 can be disposed about the entire periphery of the pole 22. An adjustable clamp, such as a hose clamp 14 can be placed over the pole 22 and the pads 18 to secure the pads 18 to the pole 22. In some embodiments, the hose clamp 14 can be a quick release clamp. The hose clamps 14 can also pass through center slots of the channel brackets 12, as shown in FIG. 2, for example, to secure the channel brackets 12 to the pads 18, which are secured to the pole 22.

The channel brackets 12 can be disposed on opposite sides of the pole 22, with a first set of two channel brackets 12 disposed on a first height of the pole 22, and a second set of two channel brackets 12 disposed on a second height of the pole 22. Hose clamps 14 can be used to span between the two channel brackets 12 at the first height, typically, one hose clamp 14 on each side of the pole 22, and another hose clamp 14 can be used to span between the two channel brackets 12 at the second height, typically one hose clamp 14 on each side of the pole 22. The hose clamps used to hold the channel brackets 12 against the pole 22 can be the same or different in design from the hose clamps used to secure the pads 18 to the pole 22.

The banner 10 can have a wrap-around portion 10C designed to wrap around the channel bracket 12 to a back side thereof. The wrap-around portion 10C can include a reinforced region with a hole there through, such as a grommet 26. A tie wrap 16A can fit through the grommet 26 and be secured to the channel bracket 12 through a channel slot 24 formed therein. At least one grommet 26 can be disposed on each corner of the banner 10 in the wrap-around portion 10C thereof, however, more than one such grommet 26 can be disposed in the wrap-around portion 10C. The tie wraps 16A can be secured to the channel bracket 12 such that tightening the tie wrap 16A pulls the banner 10 taut between the channel brackets 12.

A banner cut out region 10B can be designed so that the wrap-around portion 10C does not extend to where the channel brackets 12 attach to the pole 22. The cut out region 10B can be reinforced and can be about 1.5 inches high and from about 6 to about 8 inches wide. This cut out region 10B allows the banner wrap-around portion 10C to be wrapped around the channel bracket 12 without having excess banner 10 that cannot wrap around the channel bracket 12 at the location of the pole 22.

Figure 5:
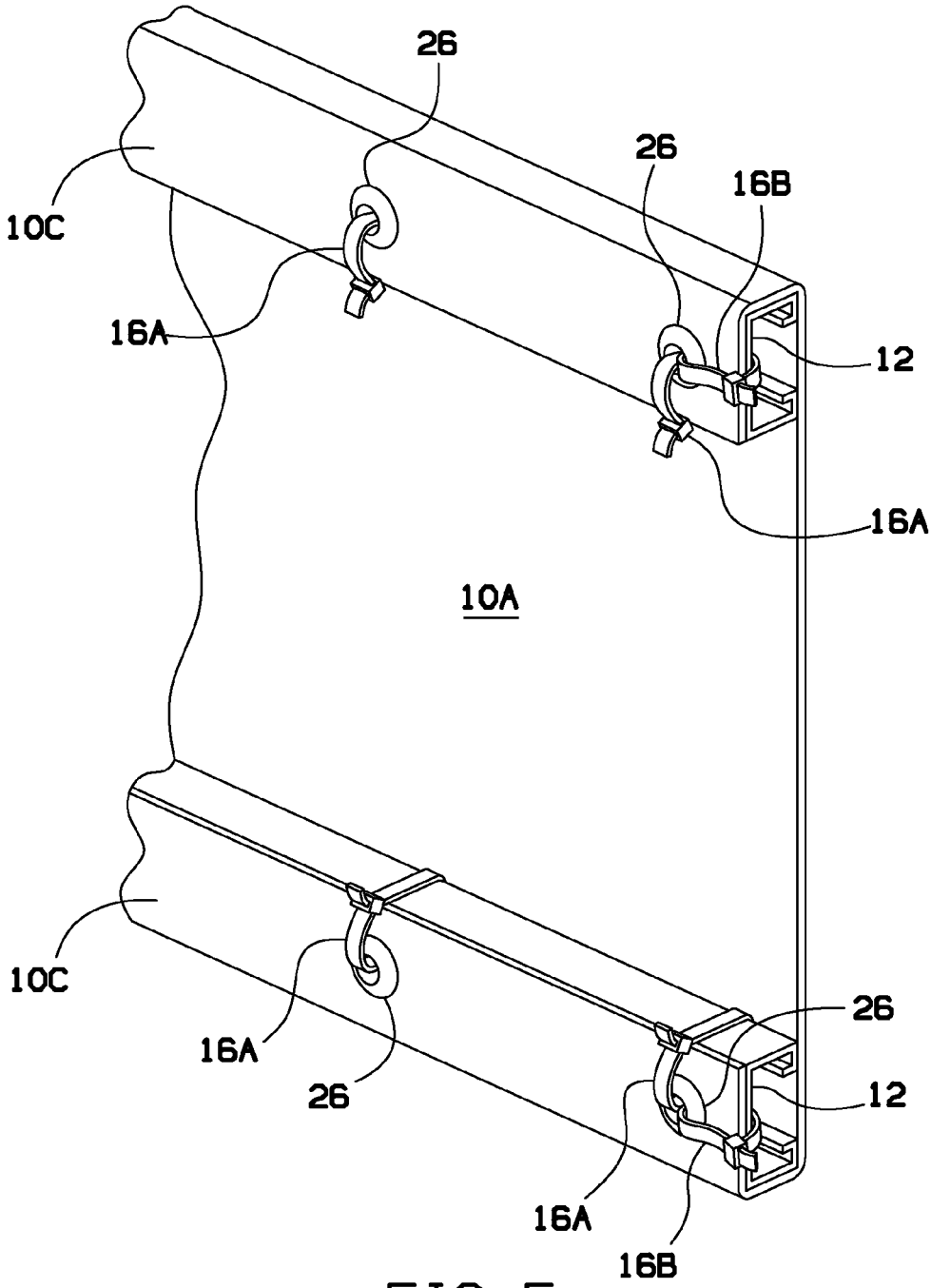
FIG. 5 is a detailed perspective view of the double wide pole bracket, in use to apply a banner to a pole, illustrating the use of an additional tie wrap at each end of the channel.

In some embodiments, as shown in FIG. 5, an additional tie wrap 16B can extend from the grommet 26 out to the end of the channel bracket 12. This tie wrap 16B can be designed so that tightening of the tie wrap 16B pulls the banner 10 widthwise, creating a further mechanism to make the banner 10 taut horizontally.

Figure 6:
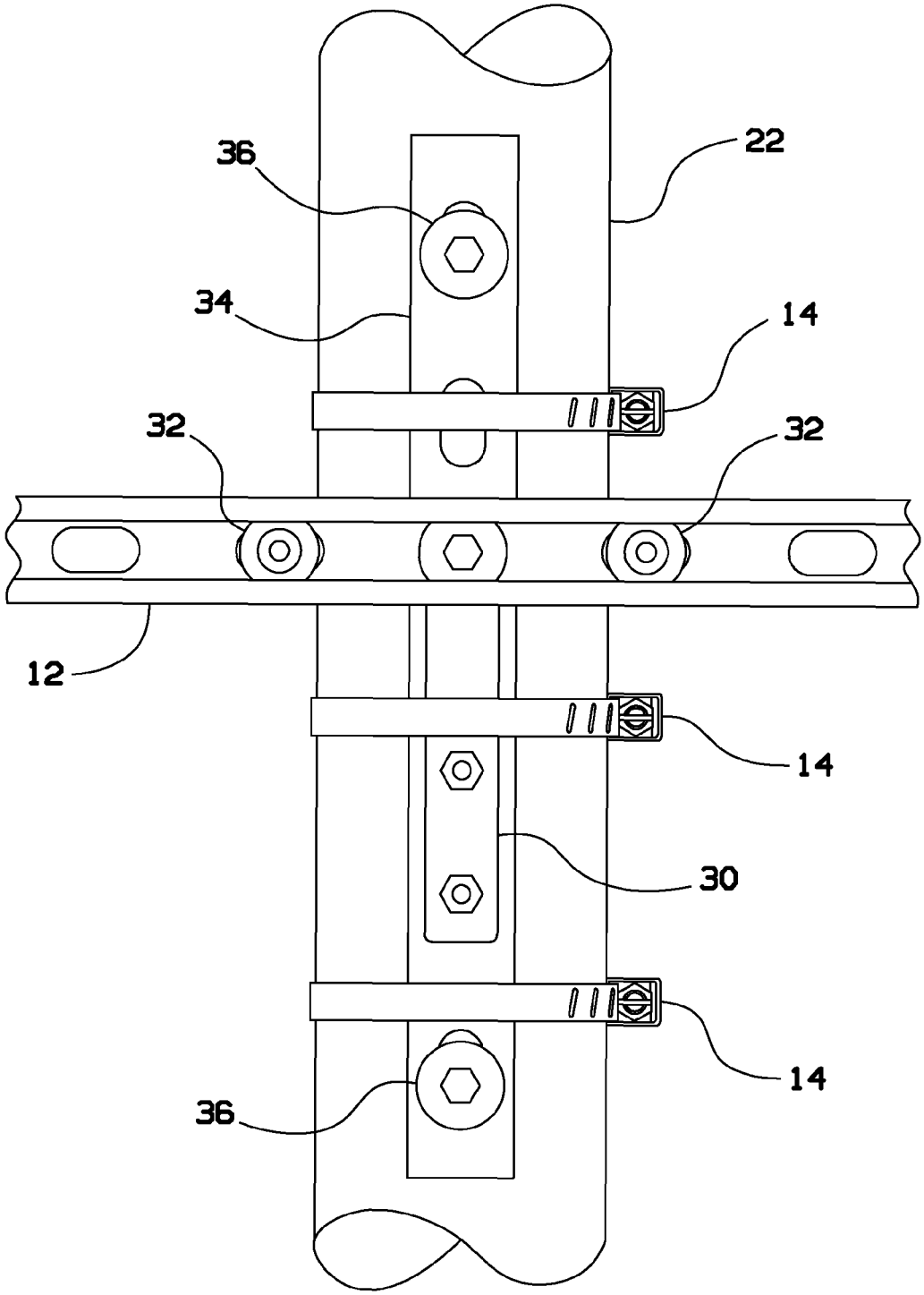
FIG. 6 is a perspective view illustrating a method for preventing slipping of a banner on a round pole according to an exemplary embodiment of the present invention.

In some embodiments, as shown in FIG. 6, a channel strut 34 can be disposed, parallel to the longitudinal axis of the pole 22, where each channel bracket 12 meets the pole 22. The channel strut 34 can be a slotted channel that can be strapped to the pole using a plurality of clamps 14, typically three clamps 14. A T-brace 30 can attach to the channel strut 34 and extend outwards from the channel strut 34 at 90 degree angles from each side thereof. The channel bracket 12 can then be secured to the T-brace 30, by, for example, cone nuts 32. In some embodiments, a total of four channel struts 34 can be deployed, one for each location where each channel bracket 12 meets the pole 22. In other embodiments, two channel struts 34 can be used, one spanning between two front channel brackets and one spanning between two rear channel brackets. In this embodiment, two T-braces 30 are disposed on each channel strut 34.

While the Figures show the pole 22 as being a round pole, the banner system of the present invention can be installed on any shape of vertical pole using any number or configuration of clamps 14 required for that configuration.

The channel brackets 12 can be made of various materials, such as aluminum, steel, and the like, typically galvanized steel. While the channel brackets 12 are shown as C-shaped, various shapes, such as round or square, for example, could be used with holes drilled therethrough for the channel slots 24. While the above discusses the use of Neoprene pads, other pad materials, such as rubber, can be used. The hose clamps can be made from various materials, such as steel, stainless steel, or the like. The zip ties can be plastic zip ties and, where necessary, can be designed to be resistant to ultraviolet rays to prevent breakdown over time for banners that may be displayed over long periods of time.

The banner system of the present invention can be used in various locations, including, for example, light poles in retail parking lots, city streets, college campuses, and the like. Unlike conventional banners that are often hard to read and decipher, ripped, or blown off altogether, the banner system of the present invention can provide banners of desirable sizes to be securely and safely mounted on poles and other similar mounting structures.

It should be understood, of course, that the foregoing relates to exemplary embodiments of the invention and that modifications may be made without departing from the spirit and scope of the invention as set forth in the following claims.

What is claimed is:

1. A pole bracket and banner system comprising:

a first set of two channel brackets disposed at a first height on a pole;

a second set of two channel brackets disposed at a second height on the pole;

a plurality of channel slots in the first and second sets of two channel brackets;

a first adjustable strap disposed about the pole at the first height, the first adjustable strap extending into one of the plurality of channel slots on each of the first set of two channel brackets and exiting from an adjacent one of the plurality of channel slots on each of the first set of two channel brackets, where tightening the first adjustable strap to the pole secures the first set of two channel brackets at the first height;

a second adjustable strap disposed about the pole at the second height, the second adjustable strap extending into one of the plurality of channel slots on each of the second set of two channel brackets and exiting from an adjacent one of the plurality of channel slots on each of the second set of two channel brackets, where tightening the second adjustable strap to the pole secures the second set of two channel brackets at the second height;

a first set of two adjustable straps extending about and interconnecting the first set of two channel brackets on each side of the pole; and a second set of two adjustable straps extending about and interconnecting the second set of two channel brackets on each side of the pole.

2. The pole bracket and banner system of claim 1, further comprising a banner extending between one of the first set of two channel brackets and one of the second set of two channel brackets.

3. The pole bracket and banner system of claim 2, wherein the banner includes a banner cut-out region disposed in a region where the channel brackets contact the pole.

4. The pole bracket and banner system of claim 2, wherein the banner includes at least one grommet in a banner wrap-around region disposed on each corner of the banner.

5. The pole bracket and banner system of claim 4, further comprising zip ties securing the grommets of the banner to the channel brackets.

6. The pole bracket and banner system of claim 1, wherein each of the adjustable straps are quick release adjust straps.

7. The pole bracket and banner system of claim 1, further comprising an anti-slip protective pad disposed between the channel brackets and the pole.

8. The pole bracket and banner system of claim 7, wherein the anti-slip protective pad is a neoprene pad.

9. A banner display system comprising:

a first set of two channel brackets disposed at a first height on a pole;

a second set of two channel brackets disposed at a second height on the pole;

an anti-slip protective pad disposed between the channel brackets and the pole;

a plurality of channel slots in the first and second sets of two channel brackets;

a first adjustable strap disposed about the pole at the first height, the first adjustable strap extending into one of the plurality of channel slots on each of the first set of two channel brackets and exiting from an adjacent one of the plurality of channel slots on each of the first set of two channel brackets, where tightening the first adjustable strap to the pole secures the first set of two channel brackets at the first height;

a second adjustable strap disposed about the pole at the second height, the second adjustable strap extending into one of the plurality of channel slots on each of the second set of two channel brackets and exiting from an adjacent one of the plurality of channel slots on each of the second set of two channel brackets, where tightening the second adjustable strap to the pole secures the second set of two channel brackets at the second height;

a first set of two adjustable straps extending about and interconnecting the first set of two channel brackets on each side of the pole;

a second set of two adjustable straps extending about and interconnecting the second set of two channel brackets on each side of the pole;

a banner extending between one of the first set of two channel brackets and one of the second set of two channel brackets;

a banner cut-out region disposed in a region where the channel brackets contact the pole; and at least one grommet in a banner wrap-around region disposed on each corner of the banner.

10. The banner display system of claim 9, wherein the anti-slip protective pad is a neoprene pad.

* * * * *